US011645990B2

(12) United States Patent
Zhang et al.

(10) Patent No.: US 11,645,990 B2
(45) Date of Patent: May 9, 2023

(54) METHOD AND APPARATUS FOR CONTROLLING DISPLAY PANEL, DISPLAY MODULE AND ELECTRONIC DEVICE

(71) Applicants: Chongqing BOE Optoelectronics Technology Co., Ltd., Chongqing (CN); BOE Technology Group Co., Ltd., Beijing (CN)

(72) Inventors: Xiuqin Zhang, Beijing (CN); Lisheng Liang, Beijing (CN); Wenliang Liu, Beijing (CN); Ming Deng, Beijing (CN); Zhihua Sun, Beijing (CN); Ying Huang, Beijing (CN); Chengri Quan, Beijing (CN); Xiangyang Zheng, Beijing (CN)

(73) Assignees: Chongqing BOE Optoelectronics Technology Co., Ltd., Chongqing (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/458,105

(22) Filed: Aug. 26, 2021

(65) Prior Publication Data

US 2022/0093051 A1 Mar. 24, 2022

(30) Foreign Application Priority Data

Sep. 23, 2020 (CN) ..... 202011012514.0

(51) Int. Cl.
*G09G 3/36* (2006.01)

(52) U.S. Cl.
CPC ..... *G09G 3/3614* (2013.01); *G09G 3/3674* (2013.01); *G09G 3/3685* (2013.01);
(Continued)

(58) Field of Classification Search
CPC .... G09G 3/361; G09G 3/3674; G09G 3/3685; G09G 2300/0823; G09G 2320/0247; G09G 2320/0257
See application file for complete search history.

(56) References Cited

U.S. PATENT DOCUMENTS 7,362,299 B2 * 4/2008 Hosotani ..... G09G 3/3614 345/99
8,111,229 B2 * 2/2012 Song ..... G09G 3/3614 345/99

(Continued)

FOREIGN PATENT DOCUMENTS

CN 105096852 A 11/2015
CN 109817175 A 5/2019

(Continued)

OTHER PUBLICATIONS

CN2020110125140 first office action.

*Primary Examiner* — Michael J Jansen, II
(74) *Attorney, Agent, or Firm* — IPro, PLLC

(57) ABSTRACT

A method for controlling a display panel includes: controlling polarities of data signals transmitted to pixel circuits in partial columns in a target display region to be inverted when a $(KN-1)^{th}$ frame is displayed; and controlling polarities of data signals transmitted to pixel circuits in other columns than the partial columns in the target display region to be inverted when a $KN^{th}$ frame is displayed.

10 Claims, 7 Drawing Sheets

(52) U.S. Cl.
CPC ..... *G09G 2300/0823* (2013.01); *G09G 2320/0247* (2013.01); *G09G 2320/0257* (2013.01)

(56) References Cited

U.S. PATENT DOCUMENTS

| | | | | |
|---|---|---|---|---|
| 8,581,823 | B2 * | 11/2013 | Min | G09G 3/3614 345/96 |
| 9,401,125 | B2 * | 7/2016 | Cho | G09G 3/3406 |
| 9,626,028 | B2 * | 4/2017 | Li | G06F 3/04184 |
| 9,697,782 | B2 * | 7/2017 | Liu | G09G 3/3614 |
| 9,715,861 | B2 * | 7/2017 | Kim | G09G 3/3614 |
| 9,911,376 | B2 * | 3/2018 | Kim | G09G 3/2096 |
| 10,380,959 | B2 * | 8/2019 | Xin | G09G 3/36 |
| 10,896,650 | B2 * | 1/2021 | Saitoh | G09G 3/3688 |
| 2005/0093806 | A1 * | 5/2005 | Hosotani | G09G 3/3614 345/96 |
| 2008/0170025 | A1 * | 7/2008 | Song | G09G 3/3688 345/96 |
| 2009/0174642 | A1 * | 7/2009 | Min | G09G 3/3614 345/92 |
| 2010/0033475 | A1 * | 2/2010 | Choi | G09G 3/3648 345/89 |
| 2012/0299884 | A1 * | 11/2012 | Liu | G09G 3/3614 345/204 |
| 2014/0232624 | A1 * | 8/2014 | Kim | G09G 3/3607 345/87 |
| 2014/0333673 | A1 * | 11/2014 | Cho | G09G 3/3406 345/660 |
| 2016/0259455 | A1 * | 9/2016 | Li | G06F 3/04164 |
| 2016/0321984 | A1 * | 11/2016 | Kim | G09G 3/2096 |
| 2017/0140721 | A1 | 5/2017 | Chen | |
| 2017/0229078 | A1 * | 8/2017 | Xin | G09G 3/3677 |
| 2019/0073969 | A1 * | 3/2019 | Li | G09G 3/3677 |
| 2019/0164512 | A1 * | 5/2019 | Saitoh | G09G 3/3614 |
| 2019/0180710 | A1 * | 6/2019 | Kim | G09G 3/3688 |

FOREIGN PATENT DOCUMENTS

| | | | |
|---|---|---|---|
| CN | 111564134 | A | 8/2020 |
| JP | 2003005723 | A | 1/2003 |

* cited by examiner

METHOD AND APPARATUS FOR CONTROLLING DISPLAY PANEL, DISPLAY MODULE AND ELECTRONIC DEVICE

CROSS REFERENCE TO RELATED APPLICATION

This application claims priority to Chinese Patent Application No. 202011012514.0, filed on Sep. 23, 2020 and entitled "METHOD AND APPARATUS FOR CONTROLLING DISPLAY PANEL, DISPLAY PANEL AND ELECTRONIC DEVICE," the disclosure of which is incorporated herein by reference in its entirety.

TECHNICAL FIELD

The present disclosure relates to the field of liquid crystal display technologies, and in particular, relates to a method and an apparatus for controlling a display panel, a display module, and an electronic device.

BACKGROUND

Currently, liquid crystal display (LCD) technologies have been widely used in display devices. For example, televisions with liquid crystal display panels are becoming more and more universal due to their advantages such as thinness, power saving, high resolution, and no electromagnetic radiation.

SUMMARY

The present disclosure provides a method and an apparatus for controlling a display panel, a display module, and an electronic device. Embodiments of the present disclosure provide the following technical solutions.

In a first aspect of the present disclosure, a method for controlling a display panel is provided. The display panel is provided with a target display region comprising a plurality of pixel circuits arranged in an array. The method includes: controlling polarities of data signals transmitted to the pixel circuits in partial columns in the target display region to be inverted when a $(KN-1)^{th}$ frame is displayed; and controlling polarities of data signals transmitted to the pixel circuits in other columns than the partial columns of the pixel circuits in the target display region to be inverted when a $KN^{th}$ frame is displayed, wherein K is an ordinal number of a control period, and K is an integer greater than or equal to 1; and N is a number of frames corresponding to one control period, and N is an integer greater than 1.

In some varied embodiments of the first aspect of the present disclosure, the method further includes: controlling transmission of a gate drive signal to each of the pixel circuits of the display panel to be interrupted when the $(KN-1)^{th}$ frame is displayed; and controlling the transmission of the gate drive signal to be resumed when the $KN^{th}$ frame is displayed.

In some varied embodiments of the first aspect of the present disclosure, the method further includes: transmitting a gate drive signal to each of the pixel circuits of the display panel when the $(KN-1)^{th}$ frame and the $KN^{th}$ frame are displayed.

In some varied embodiments of the first aspect of the present disclosure, a gate driver on array (GOA) circuit is disposed in the display panel, and the gate drive signal is a GOA signal output from the GOA circuit.

In some varied embodiments of the first aspect of the present disclosure, the method further includes: controlling polarities of data signals transmitted to all the pixel circuits in the target display region to be inverted when each frame, other than the $(KN-1)^{th}$ frame and the $KN^{th}$ frame, is displayed in a $K^{th}$ control period.

In some varied embodiments of the first aspect of the present disclosure, the display panel is provided with a plurality of display regions, the target display region being one of the plurality of display regions.

In some varied embodiments of the first aspect of the present disclosure, the method further includes: reselecting one of the plurality of display regions as the target display region in every control period or every other at least one control period according to a preset selection sequence.

In some varied embodiments of the first aspect of the present disclosure, the method further includes: controlling polarities of data signals transmitted to all the pixel circuits in other display regions than the target display region to be inverted when each frame is displayed.

In a second aspect of the present disclosure, an apparatus for controlling a display panel is provided. The display panel is provided with a target display region comprising a plurality of pixel circuits arranged in an array. The apparatus includes a control circuit and a source drive circuit, wherein the control circuit is configured to control polarities of data signals transmitted by the source drive circuit to the pixel circuits in partial columns in the target display region to be inverted when a $(KN-1)^{th}$ frame is displayed, and control polarities of data signals transmitted by the source drive circuit to the pixel circuits in other columns than the partial columns in the target display region to be inverted when a $KN^{th}$ frame is displayed, wherein K is an ordinal number of a control period, and K is an integer greater than or equal to 1; and N is a number of frames corresponding to one control period, and Nis an integer greater than 1.

In some varied embodiments of the second aspect of the present disclosure, the apparatus further includes: a gate drive circuit, wherein the control circuit is further configured to control the gate drive circuit to interrupt transmission of a gate drive signal to each of the pixel circuits of the display panel when the $(KN-1)^{th}$ frame is displayed, and control the gate drive circuit to resume the transmission of the gate drive signal when the $KN^{th}$ frame is displayed.

In some varied embodiments of the second aspect of the present disclosure, the apparatus further includes: a gate drive circuit, wherein the control circuit is further configured to control the gate drive circuit to transmit a gate drive signal to each of the pixel circuits of the display panel when the $(KN-1)^{th}$ frame and the $KN^{th}$ frame are displayed.

In some varied embodiments of the second aspect of the present disclosure, the gate drive circuit is a gate driver on array (GOA) circuit, and the gate drive signal is a GOA signal.

In some varied embodiments of the second aspect of the present disclosure, the control circuit is further configured to control polarities of data signals transmitted by the source drive circuit to all the pixel circuits in the target display region to be inverted when each frame, other than the $(KN-1)^{th}$ frame and the $KN^{th}$ frame, is displayed in a $K^{th}$ control period.

In some varied embodiments of the second aspect of the present disclosure, the display panel is provided with a plurality of display regions, and the target display region is one of the plurality of display regions. The control circuit is further configured to reselect one of the plurality of display regions as the target display region in every control period or every other at least one control period according to a preset selection sequence.

In some varied embodiments of the second aspect of the present disclosure, the control circuit is further configured to control polarities of data signals transmitted by the source drive circuit to all the pixel circuits in other display regions than the target display region to be inverted when each frame is displayed.

In a third aspect of the present disclosure, a display module is provided. The display module includes a display panel, and the apparatus for controlling the display panel in the second aspect of the present disclosure.

In a fourth aspect of the present disclosure, an electronic device is provided. The electronic device includes: a power supply component and the display module in the third aspect. The power supply component is configured to supply power to the display module.

BRIEF DESCRIPTION OF THE DRAWINGS

The above and other objectives, features and advantages in example embodiments of the present disclosure become readily understood by reading the following detailed descriptions with reference to the accompanying drawings. In the accompanying drawings, several embodiments of the present disclosure are illustrated by way of example instead of limitations, and the same or corresponding reference numerals denote the same or corresponding parts, in which.

DETAILED DESCRIPTION

Example embodiments of the present disclosure will be described in details below with reference to the accompanying drawings. Although the example embodiments of the present disclosure are shown in the accompanying drawings, it should be understood that the present disclosure may be implemented in various fashions and should not be limited by the embodiments set forth herein. On the contrary, these embodiments are provided to enable a more thorough understanding of the present disclosure and to fully convey the scope of the present disclosure to those skilled in the art.

It should be noted that, unless otherwise specified, the technical terms or scientific terms used in the present disclosure should have the general meaning understood by those skilled in the art to which the present disclosure belongs.

In order to facilitate understanding of the embodiments of the present disclosure, firstly, the related technologies of the present disclosure are briefly introduced with reference to the accompanying drawings.

A liquid crystal display (LCD) can provide a user with an excellent picture display effect. However, the display effect of the LCD is still limited by input signals, and the input signals with relatively poor quality can cause problems such as afterimage and flicker in the display panel of the LCD. For example, the TV signal is relatively poor in quality in some remote areas. After the TV signal is input into the display panel of the LCD, the phenomenon of a residual image (i.e. the afterimage) of a previous frame will occur after a certain period of time of playing.

Figure 1:
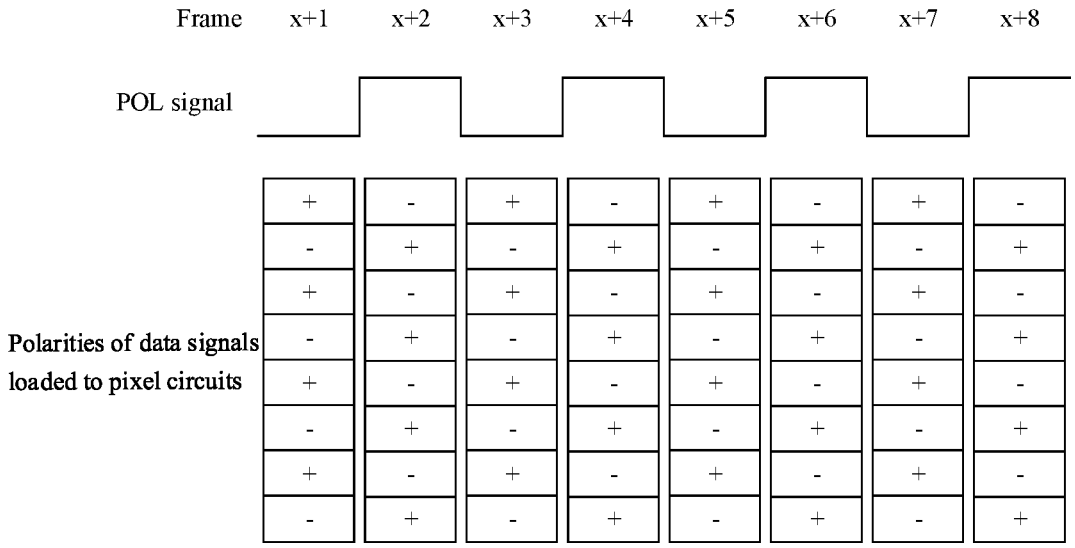
FIG. 1 (Prior Art)
FIG. 1 shows a schematic diagram of polarity inversion of a data signal transmitted to a pixel circuit in the related art.

For the liquid crystal display, voltage is applied by a pixel circuit to a liquid crystal layer to invert liquid crystal molecules, so as to change the transmittance of the liquid crystal layer, thereby controlling the luminance of the display panel. If the voltage of the same polarity is always applied to the liquid crystal molecules, the liquid crystal molecules can only invert in the same direction, which destroys the property of the liquid crystal molecules over time. Therefore, it is necessary to drive the liquid crystal molecules with positive and negative voltages in alternate. As shown in FIG. 1, it shows a schematic diagram of polarity inversion of a pixel circuit according to the related art. Under the control of a polarity inversion (POL) signal, voltage polarities of data signals loaded to all pixel circuits may be inverted in each frame, such that the voltage polarities of the data signals loaded to all the pixel circuits in a next frame (for example, the $(x+2)^{th}$ frame in FIG. 1) are opposite to those of the data signals loaded to all the pixel circuits in a previous frame (for example, the $(x+1)^{th}$ frame in FIG. 1). Here, each box represents one pixel circuit, "+" in the box indicates that the voltage polarity of the data signal loaded to the pixel circuit is positive, and "−" in the box indicates that the voltage polarity of the data signal loaded to the pixel circuit is negative.

Figure 2:
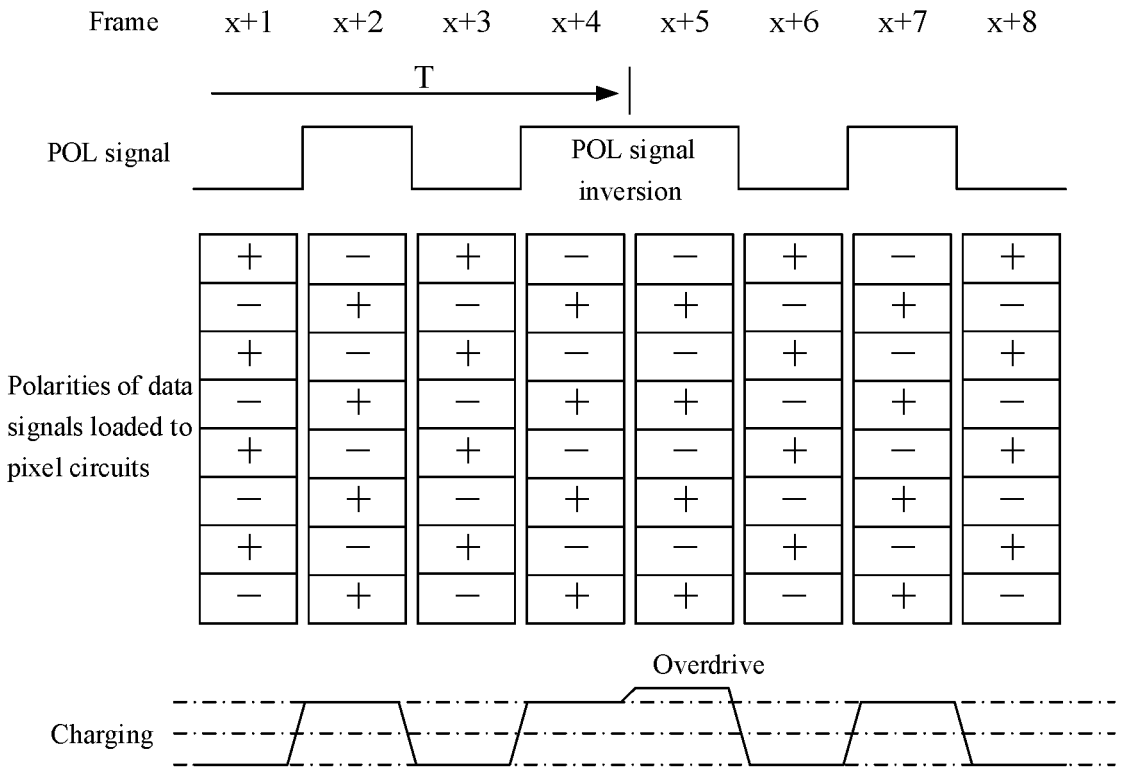
FIG. 2 (Prior Art)
FIG. 2 shows a schematic diagram of a principle of a POL signal inversion technology in the related art.

On the basis of FIG. 1, in order to solve the problem of afterimage, the technical solution of inversion of the POL signal is provided in the related art. As shown in FIG. 2, it shows a schematic diagram of a principle of an inversion technology of the POL signal in the related art. The POL signal is inverted every period T. After the POL signal is inverted, the voltage polarity of the data signal loaded to the pixel circuit in the first frame ($(x+5)^{th}$ frame in FIG. 2) after the inversion is the same as that of the data signal loaded to the pixel circuit in the last frame ($(x+4)^{th}$ frame in FIG. 2) before the inversion. Thus, the charging effect of the first frame image after the inversion is better than that of any other frame image, and an overdrive phenomenon occurs in the first frame image after the inversion, which causes the display brightness of the first frame after the inversion to be higher than that of any other frame image. Thus, there is a flicker problem during viewing, which adversely affects the viewing experience.

Therefore, it is necessary to provide a technical solution that can solve both the problem of afterimage and the problem of picture flicker.

The embodiments of the present disclosure provide a method and an apparatus for controlling a display panel, a display module, and an electronic device, which can solve the problems of afterimage and flicker in the current liquid crystal display panel. Descriptions are provided below with reference to the accompanying drawings.

Figure 3:
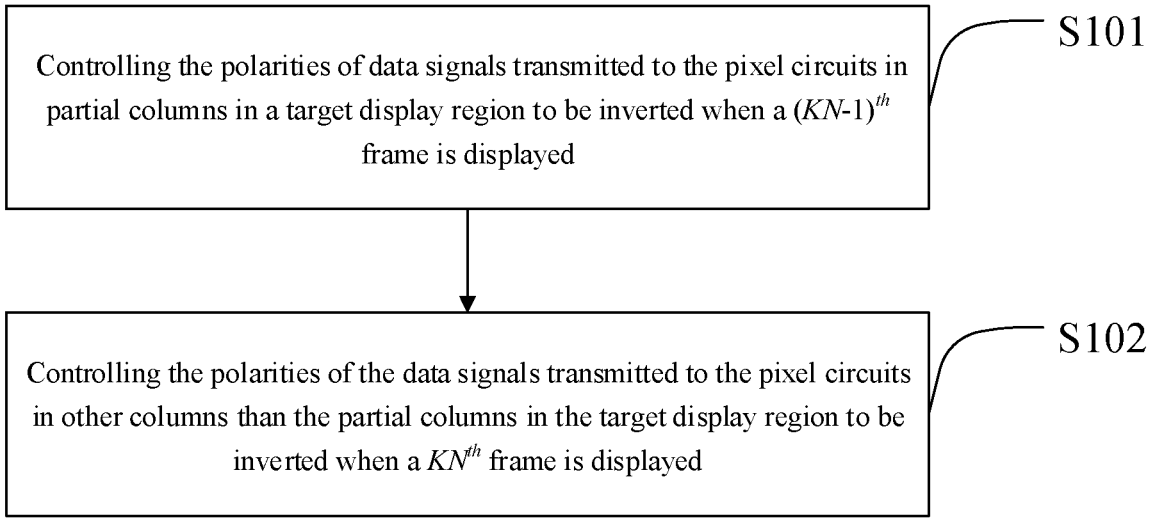
FIG. 3 shows a flowchart of a method for controlling a display panel according to some embodiments of the present disclosure.

Please refer to FIG. 3, which shows a flowchart of a method for controlling a display panel according to some embodiments of the present disclosure. The display panel is provided with a target display region including a plurality of pixel circuits arranged in an array. As shown in FIG. 3, the method for controlling the display panel includes the following steps.

In step S101, the polarities of the data signals transmitted to the pixel circuits in partial columns in the target display region is controlled to be inverted when a $(KN-1)^{th}$ frame is displayed.

Here, in the embodiments of the present disclosure, display may be controlled based on a preset control period, and the control period may be flexibly set according to actual needs. For example, the duration of control period may be 10 seconds, 14 seconds, 28 seconds, or the like, which is not limited in the embodiments of the present disclosure.

K is the ordinal number of the control period, and K may be any positive integer. N is the number of frames corresponding to one control period, N is an integer greater than 1, and the value of N may be determined based on the product of the duration of the control period and the refresh rate of the display panel. For example, if the duration of the control period is 28 seconds and the refresh rate of the display panel is 60 Hz, then N=28*60=1680.

In addition, the polarity inversion refers to the voltage polarity of the data signal transmitted to the pixel circuit is inverted from a positive polarity to a negative polarity, or the voltage polarity of the data signal transmitted to the pixel circuit is inverted from the negative polarity to the positive polarity.

In step S102, the polarities of the data signals transmitted to the pixel circuits in other columns than the partial columns in the target display region is controlled to be inverted when a $KN^{th}$ frame is displayed.

Optionally, the display panel provided in the embodiment of the present disclosure may be a liquid crystal display panel. In the liquid crystal display panel, the data signal is generally provided by a data line, and the data line is connected with the pixel circuits by column. Therefore, in the embodiment of the present disclosure, the polarities of the data signals transmitted to the pixel circuits may be controlled by column. For example, the polarities of the data signals transmitted to the pixel circuits in partial columns is controlled to be inverted every time.

In the embodiment of the present disclosure, all the pixel circuits in the target display region are divided into two parts by column, and the polarities of the data signals transmitted to the two parts of pixel circuits are inverted separately. Here, the pixel circuits in the partial columns and the pixel circuits in the other columns may be spaced apart. That is, the two parts of pixel circuits may be arranged in a staggered fashion. For example, every other a column(s) of pixel circuits may be selected as the above the pixel circuits in the partial columns, and the remaining pixel circuits may be taken as the pixel circuits the other columns. The above a may be any positive integer, such as 1, 2, 3, 4 or the like, which is not limited in the embodiments of the present disclosure. Those skilled in the art may flexibly set the value of the a based on the technical concept, and all of values should fall within the protection scope of the present disclosure.

Figure 4:
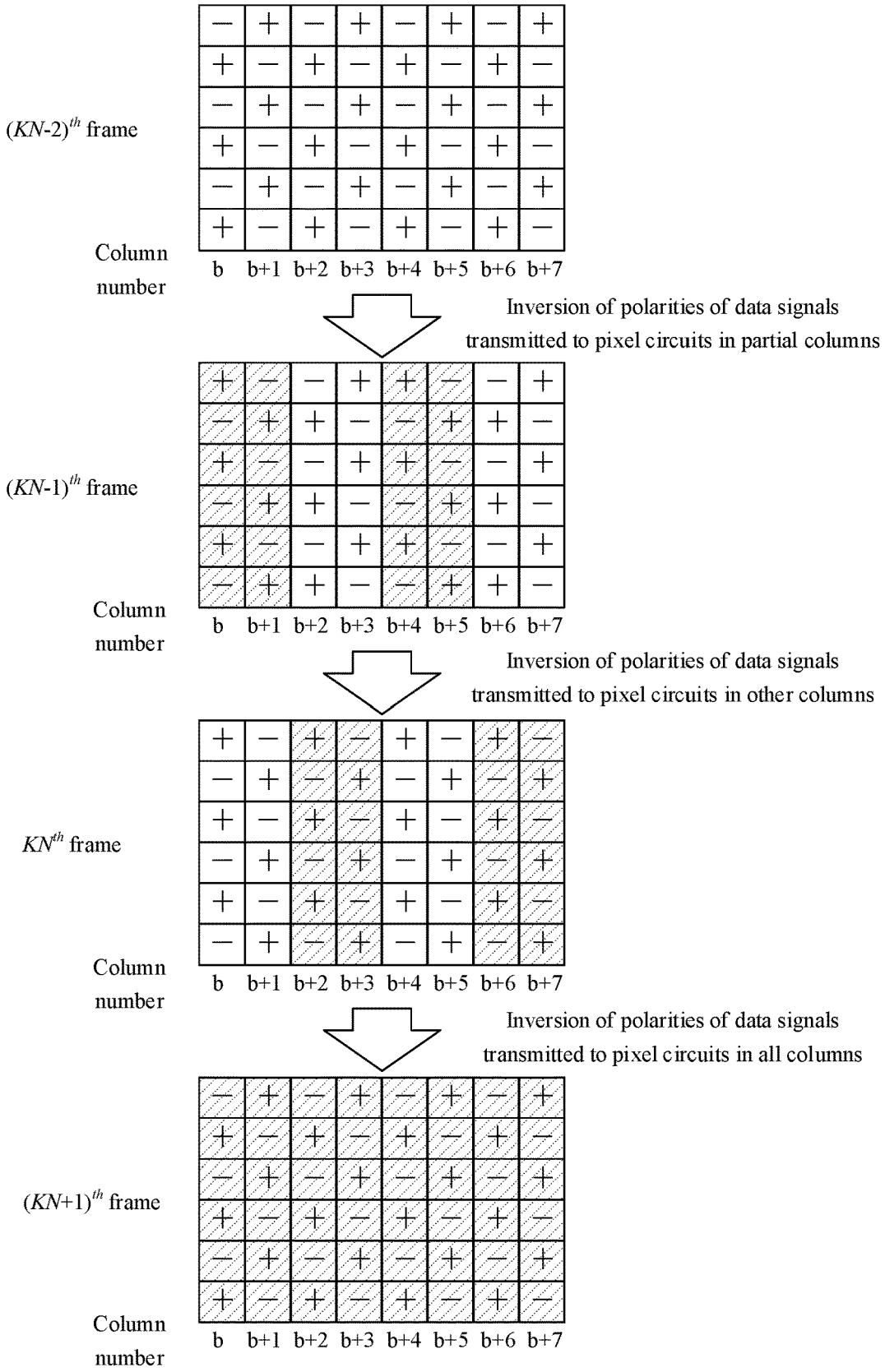
FIG. 4 shows a schematic diagram of polarity inversion of a data signal transmitted to a pixel circuit according to some embodiments of the present disclosure.

For the convenience of understanding, please refer to FIG. 4, which shows a schematic diagram of polarity inversion of a pixel circuit according to some embodiments of the present disclosure. The value of the above a may be 2. That is, every 2 columns, 2 columns of pixel circuits are taken as the pixel circuits in the partial columns. In the figure, the pixel circuits subject to polarity inversion in each frame are marked by line shading. As shown in FIG. 4, in the $(KN-1)^{th}$ frame, voltage polarities of the data signals transmitted to the pixel circuits in partial columns (for example, the b, b+1, b+4, and b+5 columns in the figure) are inverted. In the $KN^{th}$ frame, voltage polarities of the data signals transmitted to the pixel circuits in other columns (for example, the b+2, b+3, b+6, and b+7 columns in the figure) are inverted. Therefore, after the twice inversion in the $(KN-1)^{th}$ frame and the $KN^{th}$ frame, the voltage polarities of the data signals transmitted to all the pixel circuits in the $KN^{th}$ frame are all opposite to the voltage polarities of the data signals transmitted to all the pixel circuits in the $(KN-2)^{th}$ frame, which effectively solves the problem of afterimage.

According to the method for controlling the display panel according to the embodiment of the present disclosure, the polarity of the data signal transmitted to the pixel circuits in partial columns in the target display region is controlled to be inverted when a $(KN-1)^{th}$ frame is displayed, and the polarity of the data signal transmitted to the pixel circuits in other columns in the target display region is controlled to be inverted when a KM frame is displayed. The polarities of the data signals transmitted to part of the pixel circuits are inverted in each of the $(KN-1)^{th}$ frame and $KN^{th}$ frame, which can effectively improve the overdrive problem, compared with the POL signal inversion technology. Therefore, the problem of the picture flicker during viewing the display panel can be avoided, to ensure a better viewing experience of users.

Figure 5:
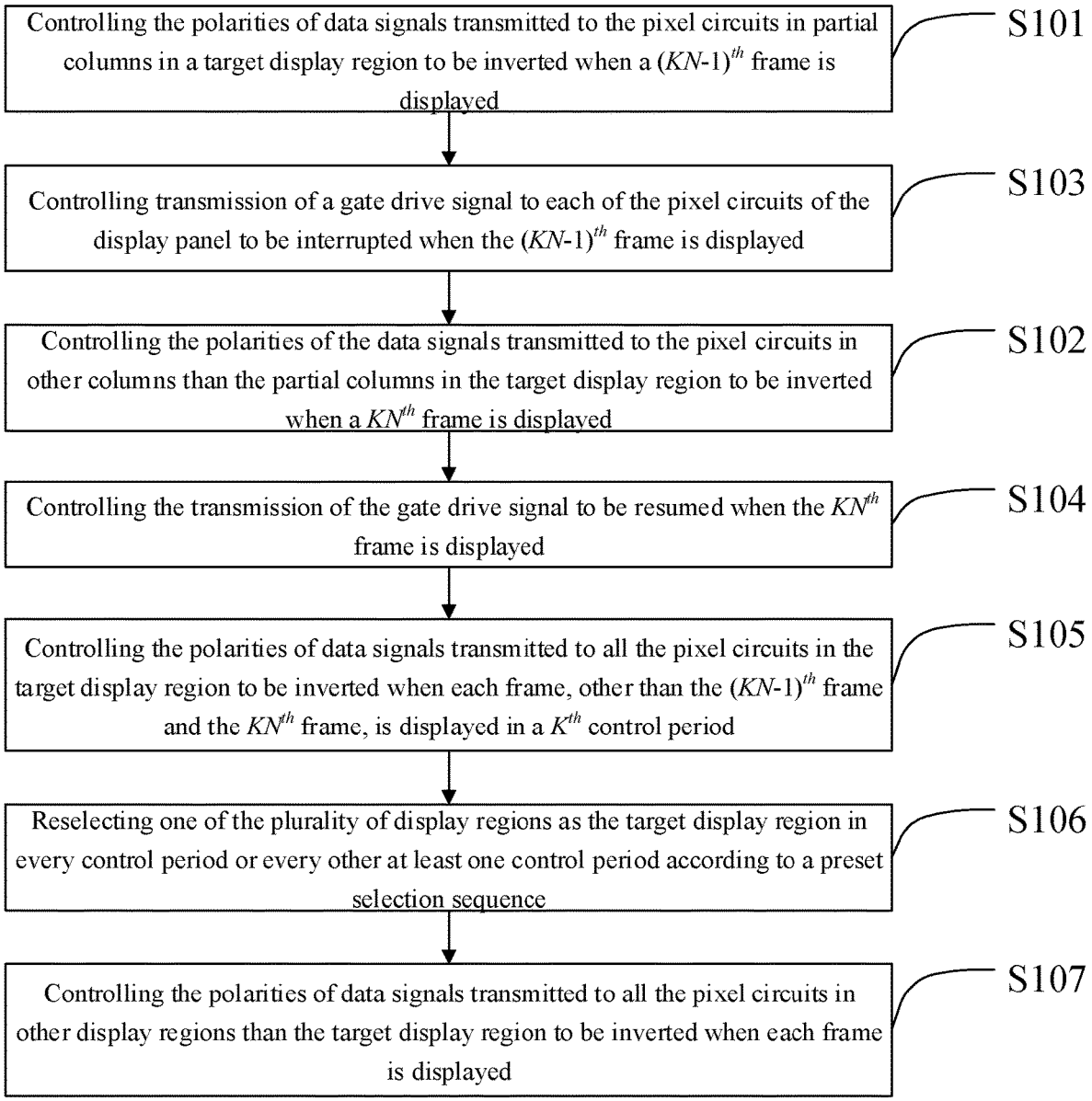
FIG. 5 shows a flowchart of a method for controlling a display panel according to other embodiments of the present disclosure.

In some embodiments, as shown in FIG. 5, the method for controlling the display panel according to the embodiments of the present disclosure may further include the following steps.

In step S103, transmission of a gate drive signal to each of the pixel circuits of the display panel is controlled to be interrupted when the $(KN-1)^{th}$ frame is displayed.

By controlling the transmission of the gate drive signal to be interrupted, charging all the pixel circuits in the display panel may be stopped. Correspondingly, the display panel may display the image of the previous frame (i.e., the $(KN-2)^{th}$ frame).

In step S104, the transmission of the gate drive signal is controlled to be resumed when the $KN^{th}$ frame is displayed.

After the transmission of the gate drive signal is controlled to be resumed, all the pixel circuits in the display panel may be charged normally.

Based on the above implementation, when the $(KN-1)^{th}$ frame is displayed, since the transmission of the gate drive signal is interrupted, the data signal transmitted by the data line cannot be loaded to the pixel circuit. Thus, the voltage polarities of the data signals actually loaded to the pixel circuits in partial columns in the target display region cannot be inverted.

When the $KN^{th}$ frame is displayed, the data signal transmitted by the data line can be loaded to the pixel circuit after the transmission of the gate drive signal is resumed. Thus, the voltage polarities of the data signals actually loaded to the pixel circuits in the other columns in the display panel can be inverted.

It is to be understood that the above step S103 and step S101 may be executed synchronously, and the above step S104 and step S102 may be synchronously executed.

In an optional implementation, the method for controlling the display panel according to the embodiments of the present disclosure may further include: transmitting a gate drive signal to each of the pixel circuits of the display panel when the $(KN-1)^{th}$ frame and the $KN^{th}$ frame are displayed.

Based on this implementation, the gate drive signal can be normally provided to the pixel circuit when the $(KN-1)^{th}$ frame and the $KN^{th}$ frame are displayed. Therefore, when the $(KN-1)^{th}$ frame is displayed, the voltage polarities of the data signals actually loaded to the pixel circuits in partial columns in the target display region are inverted. When the $KN^{th}$ frame is displayed, the voltage polarities of the data signals actually loaded to the pixel circuits in the other columns in the target display region are inverted.

It is to be understood that the display panel is provided with a gate driver on array (GOA) circuit, and the above gate drive signal may be a GOA signal output from the GOA circuit. Here, the GOA technology is to integrate a thin film transistor (TFT) gate drive circuit on the array substrate of a display panel, to perform scanning drive on the display panel. In this technology, the wiring space of the bonding region and the fan-out region of a gate integrated circuit (IC) can be omitted. Therefore, not only the product costs in terms of material cost and manufacturing process can be reduced, but also the display panel can be beautifully designed with symmetrical sides and a narrow frame.

One of the functions of the above gate drive signal (e.g., the GOA signal) is to control the switch-on or switch-off of the switching transistor (e.g., TFT) in the pixel circuit. After the transmission of the gate drive signal is controlled to be interrupted, the switching transistor in the pixel circuit is switched off, and charging of the pixel circuit stops. After the transmission of the gate drive signal is controlled to be resumed, the switching transistor in the pixel circuit is switched on, and charging of the pixel circuit resumes. In this way, by stopping charging in the $(KN-1)^{th}$ frame and resuming charging in the $KN^{th}$ frame, the overdrive phenomenon in the $KN^{th}$ frame can be effectively avoided, which can thereby avoid the problem of flicker.

Here, charging of the pixel circuit may be that the data signal provided by the data line is loaded to the pixel electrode in the pixel circuit through the switching transistor, thereby charging the pixel electrode.

It should be understood that the format of the GOA signal may be made reference to the related art, and the GOA signal may include a STV (start signal), a multi-channel clock signal CLK, and the like. In addition, the GOA signal may further include a STV0 (stop signal), a first power supply signal VDDE, a second power supply signal VDDO, a first driving voltage VGL, a second driving voltage LVGL, and the like, which is not limited in the embodiments of the present disclosure.

In this embodiment of the present disclosure, by interrupting the transmission of the gate drive signal in the $(KN-1)^{th}$ frame and resuming the transmission of the gate drive signal in the $KN^{th}$ frame, charging may be stopped in the $(KN-1)^{th}$ frame and resumed in the $KN^{th}$ frame, which can avoid the problem of luminance flicker caused by the excessively high driving voltage of the $KN^{th}$ frame from due to charging in the two consecutive frames. In addition, by completing the POL signal inversion completed in one frame in the related art in two frames, the problem of afterimage and the problem of luminance flicker caused by the POL signal inversion completed in one frame can be avoided.

Figure 6:
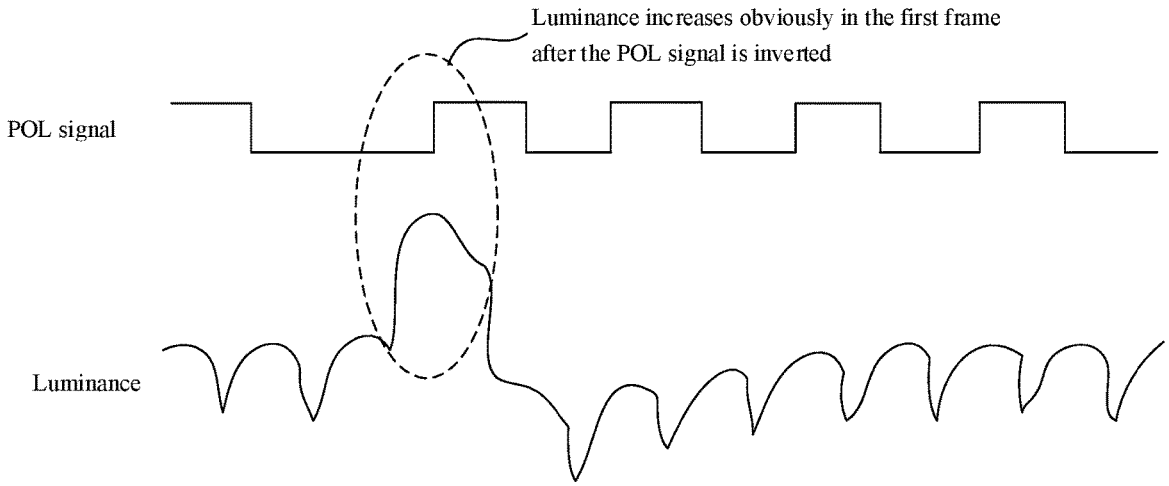
FIG. 6 shows a schematic waveform diagram of frame luminance change corresponding to a POL signal in the polarity inversion shown in FIG. 2.
Figure 7:
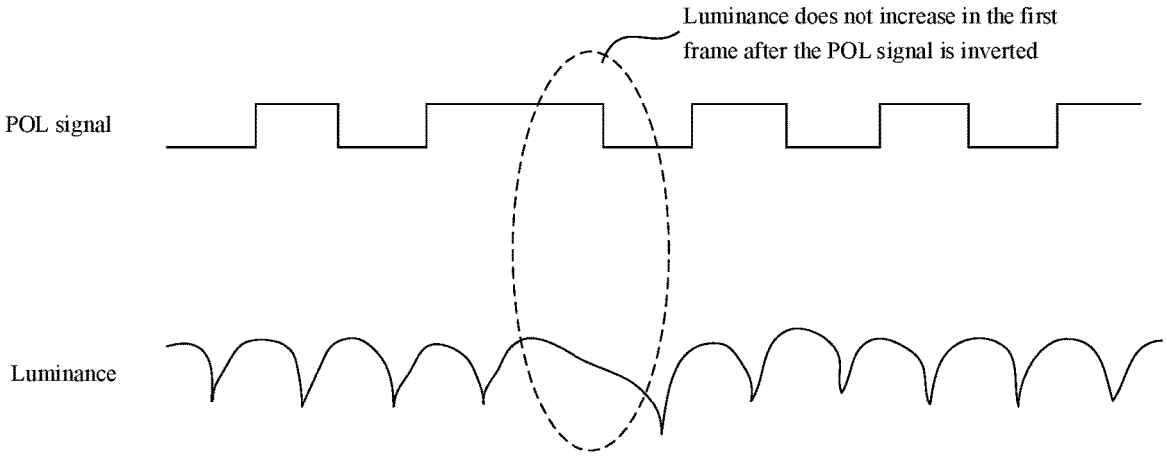
FIG. 7 shows a schematic waveform diagram of frame luminance change corresponding to a POL signal in polarity inversion according to an embodiment of the present disclosure.

For descriptions of the technical effects of the embodiments of the present disclosure, please refer to FIG. 6 and FIG. 7. FIG. 6 shows a schematic waveform diagram of frame luminance change corresponding to the POL signal in a polarity inversion shown in FIG. 2, and FIG. 7 shows a schematic waveform diagram of frame luminance change corresponding to the POL signal in a polarity inversion according to an embodiment of the present disclosure. In FIG. 6, the luminance of the first frame after the POL signal is inverted increases obviously, which causes the problem of flicker. However, in FIG. 7, the luminance of the first frame after the POL signal is inverted does not increase, which can effectively solve the problem of flicker. For example, if the control period T is 28 seconds, it is tested that compared with the polarity inversion shown in FIG. 2, the degree of flicker in the embodiment of the present disclosure can be reduced by 60%, and the flicker is almost invisible to human eyes. In addition, the solution provided in the embodiment of the present disclosure can effectively solve the problem of afterimage, and can be effectively applicable to input signals with relatively poor quality. This solution has a good effect in a 55-inch 4K dual gate display panel.

Display of frames other than the above $(KN-1)^{th}$ frame and $KN^{th}$ frame may be controlled as follows. In some varied implementations, with continued reference to FIG. 5, the method for controlling the display panel may further include the following step.

In step S105, the polarities of data signals transmitted to all the pixel circuits in the target display region are controlled to be inverted when each frame, other than the $(KN-1)^{th}$ frame and the $KN^{th}$ frame, is displayed in a $K^{th}$ control period.

As shown in FIG. 4, from the $(KN+1)^{th}$ frame, the voltage polarities of the data signals transmitted to all the pixel circuits are inverted in each frame until the end of the current control period. For example, if the $(KN-1)^{th}$ frame is the start frame of the current $K^{th}$ control period, the $((K+1)N-2)^{th}$ frame is the end frame of the current $K^{th}$ control period. Then, the voltage polarities of all the pixel circuits in the target display region need to be controlled to be inverted in each frame from the $(KN+1)^{th}$ frame to the $((K+1)N-2)^{th}$ frame.

Figure 8:
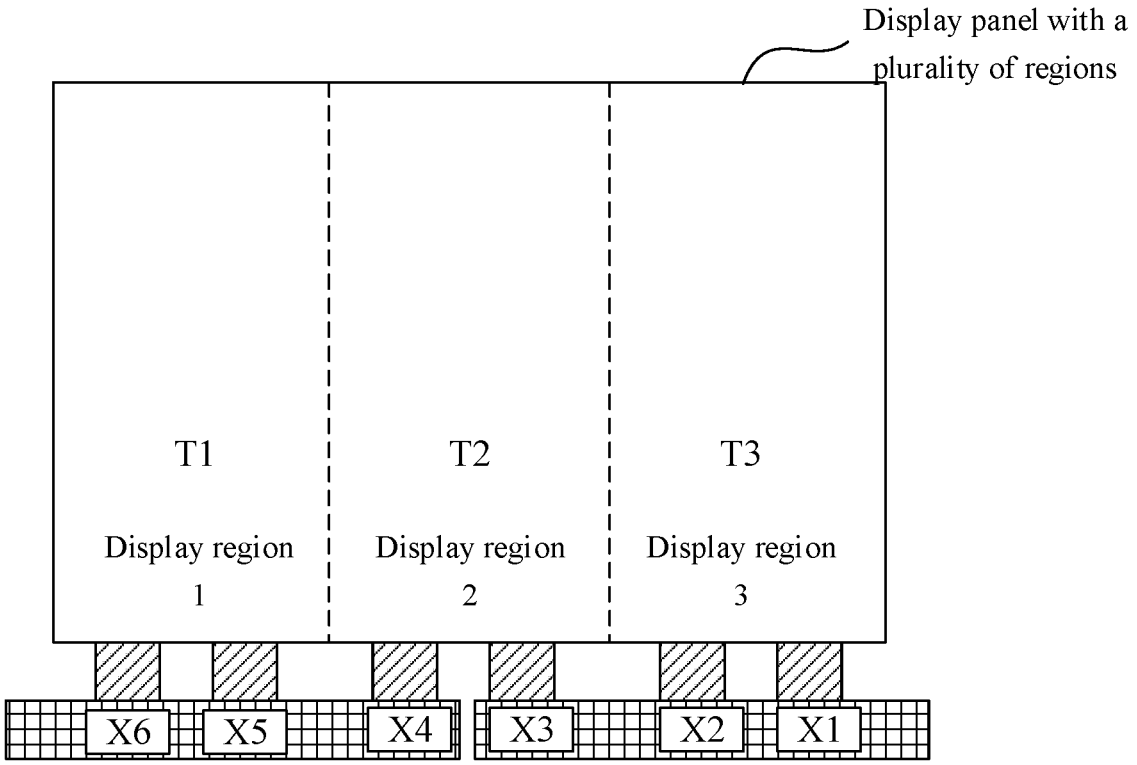
FIG. 8 shows a schematic diagram of a display panel with a plurality of display regions.

It is to be understood that the above target display region may be the entire display region of the display panel, or may be partial display region of the display panel, which is not limited in the embodiments of the present disclosure. For example, the display panel may be divided into a plurality of display regions to control partitioned display, respectively. Here, each display region may also be referred to as one partition. As shown in FIG. 8, it shows a schematic diagram of a display panel with a plurality of display regions. The display panel with a plurality of display regions includes three display regions: display region 1, display region 2, and display region 3. The target display region may be any one of the display regions, or may be a combination of a plurality of the display regions, which is not limited in the embodiments of the present disclosure.

In addition, the number of the display regions is not limited in the embodiments of the present disclosure. Those skilled in the art may flexibly set the number of the display regions according to actual needs, all of which can achieve the purpose of the embodiments of the present disclosure and should fall within the protection scope of the present disclosure.

Based on the above descriptions, for the display panel with a plurality of display regions, the display regions may be controlled, respectively. For example, in some varied implementations, the display panel includes a plurality of display regions, and the method for controlling the display panel may further include the following step, as shown in FIG. 5.

In step S106, one of the plurality of display regions is reselected as the target display region in every control period or every other at least one control period according to a preset selection sequence.

Taking FIG. 8 as an example, one display region may be reselected as the target display region in every one control period T according to the sequence of display region 1, display region 2, and display region 3. For example, the display region 1 is selected as the target display region in T1 control period, the display region 2 is selected as the target display region in T2 control period, the display region 3 is selected as the target display region in T3 control period, the display region 1 is selected as the target display region in T4 control period, and so on.

Alternatively, one display region may be reselected as the target display region every other one or a plurality of control periods T. For example, the display region 1 is selected as the target display region in T1 control period, and the display region 1 is still the target display region in T2 control period. The display region 2 is reselected as the target display region in T3 control period, and the display region 2 is still the target display region in T4 control period. The display region 3 is reselected as the target display region in T5 control period, and so on.

It is to be understood that in the circumstance that one display region is reselected as the target display region in each control period, if the display panel includes M display regions (M is an integer greater than 1), the display regions reselected in adjacent M control periods are different from each other.

Based on the above implementation, in some varied implementations, with continued reference to FIG. 5, the method for controlling the display panel may further include the following step.

In S107, the polarities of data signals transmitted to all the pixel circuits in other display regions than the target display region are controlled to be inverted when each frame is displayed.

That is, the above step S101 and step S102 and the related implementations may be performed only for the target display region. For the other display regions, the polarity inversion is still implemented based on that shown in FIG. 1. That is, the polarities of data signals transmitted to all pixel electrodes in the other display regions are inverted in each frame.

Taking FIG. 8 as an example, in the T1 control period, the above step S101 and step S102 and the related implementations are performed by taking only the display region 1 as the target display region. The polarity inversion in other display regions such as display region 2 and display region 3 are still implemented based on the polarity inversion mode shown in FIG. 1. That is, the voltage polarities of data signals transmitted to all pixel electrodes in the other display regions are inverted in each frame.

In the T2 control period, the above step S101 and step S102 and the related implementations are performed by taking only the display region 2 as the target display region. The polarity inversion in other display regions such as the display region 1 and the display region 3 are still implemented based on the polarity inversion mode shown in FIG. 1. That is, the voltage polarities of the data signals transmitted to all the pixel electrodes in the other display regions are inverted in each frame.

In the T3 control period, the above step S101 and step S102 and the related implementations are performed by taking only the display region 3 as the target display region. The polarity inversion in other display regions such as the display region 1 and the display region 2 are still implemented based on the polarity inversion mode shown in FIG. 1. That is, the voltage polarities of the data signals transmitted to all the pixel electrodes in the other display regions are inverted in each frame.

With the above solution of partitioned control, the degree of flicker caused by the inversion of the POL signal can be further reduced.

The method for controlling the display panel is provided in the above embodiments. Correspondingly, an apparatus for controlling a display panel is further provided in the present disclosure. The apparatus for controlling the display panel in the embodiment of the present disclosure may implement the above method for controlling the display panel. Please refer to FIG. 9, which shows a schematic diagram of an apparatus for controlling a display panel according to some embodiments of the present disclosure. Since the apparatus embodiments are basically similar to the method embodiments, the apparatus embodiments are described simply, and reference may be made to the descriptions in the method embodiments for related parts. The apparatus embodiments described below are merely illustrative.

Figure 9:
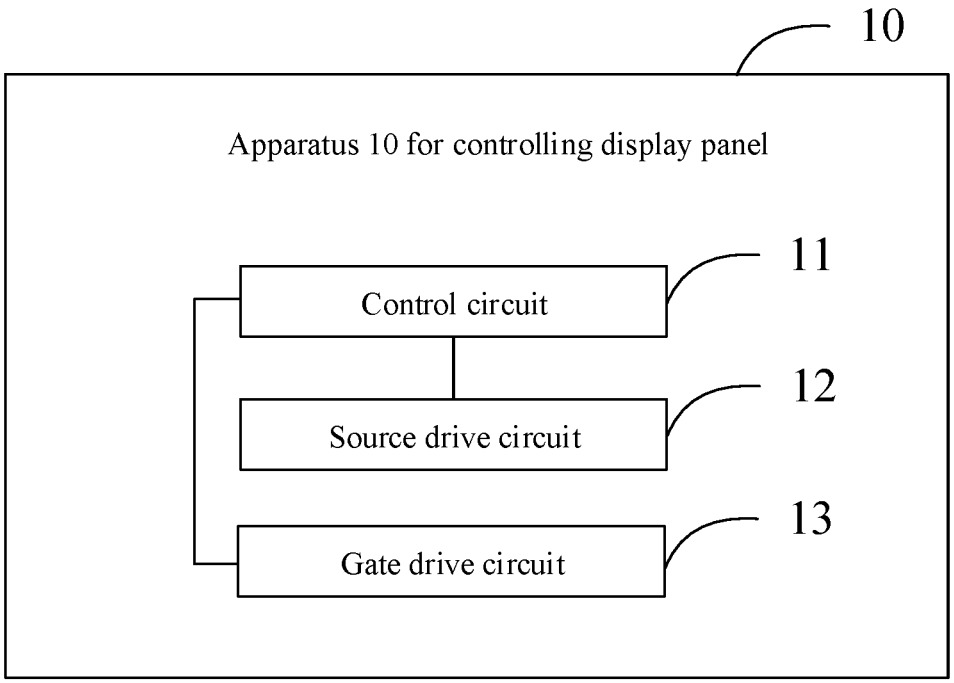
FIG. 9 shows a schematic diagram of an apparatus for controlling a display panel according to some embodiments of the present disclosure.

As shown in FIG. 9, the apparatus 10 for controlling the display panel may include: a control circuit 11 and a source drive circuit 12.

The control circuit 11 is configured to control the polarity of a data signal transmitted by the source drive circuit 12 to the pixel circuits in partial columns in a target display region to be inverted when a $(KN-1)^{th}$ frame is displayed, and control the polarity of a data signal transmitted by the source drive circuit 12 to the pixel circuits in other columns than partial columns in the target display region to be inverted when a $KN^{th}$ frame is displayed.

Here, K is the ordinal number of the control period, and K is an integer greater than or equal to 1; and N is the number of frames corresponding to one control period, and N is an integer greater than 1.

Optionally, the control circuit 11 may be a timing controller (TCON). The source drive circuit 12 may include one or more driver ICs. For example, referring to FIG. 8, the source drive circuit 12 may include 6 driver ICs from X1 to X6. Each driver IC is connected to a plurality of columns of pixel circuits, and is configured to transmit data signals to the plurality of columns of pixel circuits under the control of the control circuit 11.

In some varied implementations of the embodiments of the present disclosure, as shown in FIG. 9, the apparatus 10 for controlling the display panel may further include: a gate drive circuit 13.

The control circuit 11 is further configured to control the gate drive circuit 13 to interrupt transmission of a gate drive signal to each of the pixel circuits of the display panel when the $(KN-1)^{th}$ frame is displayed so as to stop charging all the pixel circuits in the display panel, and control the gate drive circuit 13 to resume the transmission of the gate drive signal when the $KN^{th}$ frame is displayed so as to charge all the pixel circuits in the display panel.

In some varied implementations of the embodiments of the present disclosure, the control circuit 11 is further configured to control the gate drive circuit 13 to transmit a gate drive signal to each of the pixel circuits in the display panel when the $(KN-1)^{th}$ frame and the $KN^{th}$ frame are displayed.

Here, the gate drive circuit 13 may be a GOA circuit; and correspondingly, the gate drive signal is a GOA signal.

In some varied implementations of the present disclosure, the control circuit 11 is further configured to control the polarities of the data signals transmitted by the source drive circuit 12 to all the pixel circuits in the target display region to be inverted when each frame, other than the $(KN-1)^{th}$ frame and the $KN^{th}$ frame, is displayed in the $K^{th}$ control period.

In some varied implementations of the embodiments of the present disclosure, the display panel includes a plurality of display regions, and the target display region is one of the plurality of display regions. The control circuit 11 is further configured to reselect one of the plurality of display regions as the target display region in every control period or every other at least one control period according to a preset selection sequence.

In some varied implementations of the embodiments of the present disclosure, the control circuit 11 is further configured to control the polarities of data signals transmitted by the source drive circuit 12 to all the pixel circuits in other display regions than the target display region to be inverted when each frame is displayed.

The apparatus 10 for controlling the display panel according to the embodiment of the present disclosure follows the same inventive concept and has the same beneficial effects as the method for controlling the display panel according to the foregoing embodiments of the present disclosure, which are not repeated herein.

Figure 10:
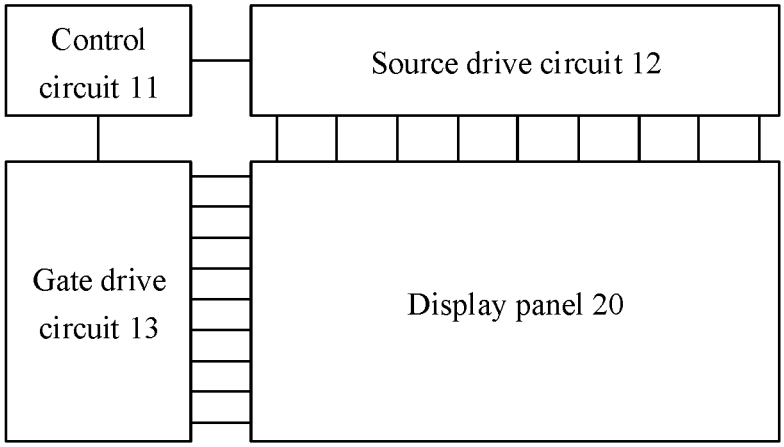
FIG. 10 shows a schematic structural diagram of a display module according to some embodiments of the present disclosure.

A display module corresponding to the method and the apparatus for controlling the display panel is further provided in an embodiment of the present disclosure. As shown in FIG. 10, the display module includes: a display panel 20, and the apparatus 10 for controlling the display panel according to the above embodiment. Here, the display panel may be a liquid crystal display panel.

The display panel according to the embodiment of the present disclosure follows the same inventive concept and has the same beneficial effects as the method and the apparatus for controlling the display panel according to the foregoing embodiments of the present disclosure.

Figure 11:
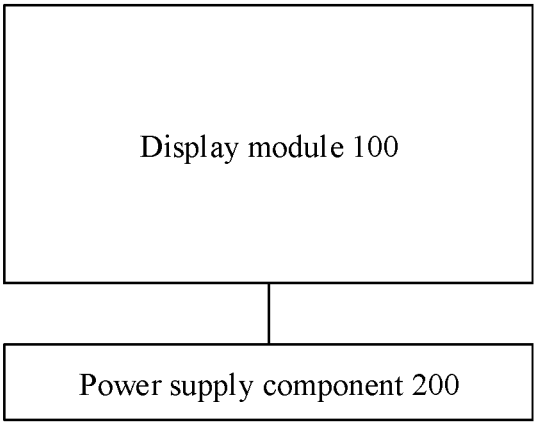
FIG. 11 shows a schematic structural diagram of an electronic device according to some embodiments of the present disclosure.

An electronic device corresponding to the method and the apparatus for controlling the display panel is further provided in an embodiment of the present disclosure. As shown in FIG. 11, the electronic device includes a power supply component 200 and the display module 100 according to the above embodiment. Here, the power supply component 200 is configured to supply power to the display module 100. The power supply component 200 may also be referred to as a power source, a power source circuit or the like.

Optionally, the electronic device may be a liquid crystal display, a liquid crystal TV, a mobile phone, a tablet computer, a notebook computer, a digital photo frame, a vehicle-mounted terminal, a navigation device, or the like, which is not limited herein.

The electronic device according to the embodiment of the present disclosure follows the same inventive concept and has the same beneficial effects as the method and the apparatus for controlling the display panel according to the foregoing embodiments of the present disclosure.

Although the exemplary embodiments of the present disclosure have been described, those skilled in the art can make additional changes and modifications to these embodiments when having knowledge of the basic creative concept. Therefore, the appended claims are intended to include the above exemplary embodiments and all changes and modifications that fall within the inventive concept of the present disclosure.

Apparently, those skilled in the art can make various amendments and variations to the present disclosure without departing from the inventive spirit and scope of the present disclosure, and the present disclosure is also intended to cover these amendments and variations if they fall within the scope of the claims of the present disclosure and equivalent technologies thereof.

What is claimed is:

1. A method for controlling a display panel, wherein the display panel is provided with a target display region comprising a plurality of pixel circuits arranged in an array; the method comprising:

controlling polarities of data signals transmitted to the pixel circuits in partial columns in the target display region to be inverted and controlling transmission of a gate drive signal to each of the pixel circuits of the display panel to be interrupted to stop charging all pixel circuits in the display panel when a $(KN-1)^{th}$ frame is displayed; controlling polarities of data signals transmitted to the pixel circuits in other columns than the partial columns of the pixel circuits in the target display region to be inverted and controlling the transmission of the gate drive signal to be resumed to normally charge all the pixel circuits in the display panel when a $KN^{th}$ frame is displayed; and inverting the polarities of the data signals transmitted to all the pixel circuits in each frame from a $(KN+1)^{th}$ frame until an end of a current control period, wherein K is an ordinal number of a control period, and K is an integer greater than or equal to 1; N is a number of frames corresponding to one control period, and N is an integer greater than 1; and the $(KN-1)^{th}$ frame is a previous frame of the $KN^{th}$ frame.

2. The method according to claim 1, wherein a gate driver on array (GOA) circuit is disposed in the display panel, and the gate drive signal is a GOA signal output from the GOA circuit.

3. The method according to claim 2, wherein the display panel is provided with a plurality of display regions; the method further comprising:

reselecting one of the plurality of display regions as the target display region in every control period according to a preset selection sequence;

controlling polarities of data signals transmitted to all the pixel circuits in other display regions than the target display region to be inverted when each frame is displayed; and controlling polarities of data signals transmitted to all the pixel circuits in the target display region to be inverted when each frame, other than the $(KN-1)^{th}$ frame and the $KN^{th}$ frame, is displayed in a $K^{th}$ control period.

4. The method according to claim 3, wherein the display panel is provided with a first display region, a second display region, and a third display region; the method further comprising:

in a $K^{th}$ control period, selecting the first display region as the target display region, and controlling polarities of data signals transmitted to all pixel circuits in the second display region and the third display region to be inverted when each frame is displayed;

in a $(K+1)^{th}$ control period, reselecting the second display region as the target display region, and controlling polarities of data signals transmitted to all pixel circuits in the first display region and the third display region to be inverted when each frame is displayed; and in a $(K+2)^{th}$ control period, reselecting the third display region as the target display region, and controlling polarities of data signals transmitted to all pixel circuits in the first display region and the second display region to be inverted when each frame is displayed.

5. An apparatus for controlling a display panel, wherein the display panel is provided with a target display region comprising a plurality of pixel circuits arranged in an array; the apparatus comprising a control circuit and a source drive circuit, wherein the control circuit is configured to control polarities of data signals transmitted by the source drive circuit to the pixel circuits in partial columns in the target display region to be inverted and control transmission of a gate drive signal to each of the pixel circuits of the display panel to be interrupted to stop charging all pixel circuits in the display panel when a $(KN-1)^{th}$ frame is displayed, control polarities of data signals transmitted by the source drive circuit to the pixel circuits in other columns than the partial columns in the target display region to be inverted and control the transmission of the gate drive signal to be resumed to normally charge all the pixel circuits in the display panel when a $KN^{th}$ frame is displayed, and invert the polarities of the data signals transmitted to all the pixel circuits in each frame from a $(KN+1)^{th}$ frame until an end of a current control period, wherein K is an ordinal number of a control period, and K is an integer greater than or equal to 1; N is a number of frames corresponding to one control period, and N is an integer greater than 1; and the $(KN-1)^{th}$ frame is a previous frame of the $KN^{th}$ frame.

6. The apparatus according to claim 5, wherein the gate drive circuit is a gate driver on array (GOA) circuit, and the gate drive signal is a GOA signal.

7. The apparatus according to claim 6, wherein the display panel is provided with a plurality of display regions; and the control circuit is further configured to:

reselect one of the plurality of display regions as the target display region in every control period according to a preset selection sequence;

control polarities of data signals transmitted by the source drive circuit to all the pixel circuits in other display regions than the target display region to be inverted when each frame is displayed; and control polarities of data signals transmitted by the source drive circuit to all the pixel circuits in the target display region to be inverted when each frame, other than the $(KN-1)^{th}$ frame and the KO frame, is displayed in a $K^{th}$ control period.

8. The apparatus according to claim 7, wherein the display panel is provided with a first display region, a second display region, and a third display region, and the control circuit is further configured to:

in a $K^{th}$ control period, select the first display region as the target display region, and control polarities of data signals transmitted to all pixel circuits in the second display region and the third display region to be inverted when each frame is displayed;

in a $(K+1)^{th}$ control period, reselect the second display region as the target display region, and control polarities of data signals transmitted to all pixel circuits in the first display region and the third display region to be inverted when each frame is displayed; and in a $(K+2)^{th}$ control period, reselect the third display region as the target display region, and control polarities of data signals transmitted to all pixel circuits in the first display region and the second display region to be inverted when each frame is displayed.

9. A display module, comprising: a display panel, and an apparatus for controlling the display panel; wherein the display panel is provided with a target display region comprising a plurality of pixel circuits arranged in an array; and the apparatus comprises a control circuit and a source drive circuit, wherein the control circuit is configured to control polarities of data signals transmitted by the source drive circuit to the pixel circuits in partial columns in the target display region to be inverted and control transmission of a gate drive signal to each of the pixel circuits of the display panel to be interrupted to stop charging all pixel circuits in the display panel when a $(KN-1)^{th}$ frame is displayed, control polarities of data signals transmitted by the source drive circuit to the pixel circuits in other columns than the partial columns in the target display region to be inverted and control the transmission of the gate drive signal to be resumed to normally charge all the pixel circuits in the display panel when a $KN^{th}$ frame is displayed, and invert the polarities of the data signals transmitted to all the pixel circuits in each frame from a $(KN+1)^{th}$ frame until an end of a current control period, wherein K is an ordinal number of a control period, and K is an integer greater than or equal to 1; N is a number of frames corresponding to one control period, and N is an integer greater than 1; and the $(KN-1)^{th}$ frame is a previous frame of the $KN^{th}$ frame.

10. An electronic device, comprising: a power supply component and the display module according to claim 9, wherein the power supply component is configured to supply power to the display module.

* * * * *